US005417047A

United States Patent [19]

Locatelli

[11] Patent Number: 5,417,047

[45] Date of Patent: May 23, 1995

[54] STOP DEVICE FOR THE SPINDLES OF A TEXTILE SPINNING MACHINE

[75] Inventor: Claudio Locatelli, Palazzolo Sull'Oglio, Italy

[73] Assignee: Industrie Meccanotessili Marzoli S.r.l., Italy

[21] Appl. No.: 96,209

[22] Filed: Jul. 23, 1993

[30] Foreign Application Priority Data

Jul. 24, 1992 [IT] Italy ..... MI92U0733

[51] Int. Cl.[6] ..... D01H 13/14; D01H 13/18

[52] U.S. Cl. ..... 57/89; 57/61; 57/88; 242/35

[58] Field of Search ..... 57/88, 78, 61, 75, 89; 242/35

[56] References Cited

U.S. PATENT DOCUMENTS

| | | | |
|---|---|---|---|
| 1,094,239 | 4/1914 | Nordell | 57/88 |
| 3,116,591 | 1/1964 | Muller | 57/88 X |
| 3,513,652 | 5/1970 | Hare | 57/88 |
| 3,999,365 | 12/1976 | Suzuki | 57/89 X |
| 4,402,177 | 9/1983 | Grimm et al. | 57/89 X |
| 4,662,165 | 5/1987 | Menegatto | 57/89 X |

FOREIGN PATENT DOCUMENTS

| | | | |
|---|---|---|---|
| 1467806 | 12/1965 | France | 57/89 |
| 446156 | 6/1927 | Germany . | |
| 1794656 | 8/1959 | Germany . | |
| 1150912 | 6/1963 | Germany | 57/88 |
| 1510098 | 4/1969 | Germany | 57/88 |
| 2919771 | 5/1979 | Germany . | |

*Primary Examiner*—Daniel P. Stodola
*Assistant Examiner*—William Stryjewski
*Attorney, Agent, or Firm*—Diller, Ramik & Wight

[57] ABSTRACT

The device comprises a support body (15) fixable to the machine structure and an operating lever (20) pivoted to the support body (15). Two parts (18*a*, 18*b*) are axially slidable within the support body (15), one carrying a brake shoe (19) arranged to act on the shank (11) of the spindle and the other engaged with the operating lever (20), the two parts (18*a*, 18*b*) being maintained axially spaced apart by a compression spring (24). A return spring (23) acts between the support body (15) and the part (18*b*) engaging the operating lever (20) to maintain the device in its inactive position. On pressing the lever (20), the brake shoe (19) is urged against the spindle shank (11) with a pressure which depends on the spring (24) interposed between the two parts (18*a*, 18*b*), independently of the force exerted on the operating lever (20), so preventing damage or operational problems arising in the spindles if the operator presses excessively on the operating lever (20).

17 Claims, 2 Drawing Sheets

Prior Art

STOP DEVICE FOR THE SPINDLES OF A TEXTILE SPINNING MACHINE

BACKGROUND OF THE INVENTION

This invention relates to a stop device for the spindles of a textile spinning machine.

In a textile spinning machine, such as a ring spinning machine, it is known that the effective production expressed in kilograms of thread, for example cotton thread, is determined by the difference between the theoretical production, calculated on the basis of the thread production rate, and the production loss, ie the lack of transformation of the silver into thread.

The effective production of the machine obviously represents the basis for costing the sold thread.

The factor mostly responsible for the production loss of the spinning machine is the thread breakage due to the pull on the fibres during the winding to form bobbins. Such breakage depends on environmental factors such as humidity and temperature of the working environment, and systemic parameters such as irregular or untimely ordinary or extraordinary maintenance of the machine. The rejoining of the broken thread, whether done manually or automatically, inevitably requires the stoppage of the spindle or spindles involved in the breakage.

To stop the spindles, devices are used in which an operating lever acts on a brake piston carrying a brake shoe which engages the shank of the spindle, so braking it. The action of the lever is opposed by a return spring, which returns the device into its inactive position when the action on the lever ceases.

The spindles are rotated by a belt by tangential contact with the spindle shanks, this contact being maintained by tensioning members in the form of rollers positioned at intervals along the path of the drive belt on that side of it distant from the spindles. The spindles are rotatably supported with their axis vertical in the fixed structure of the machine and are arranged to receive tubes on which the thread is wound.

The brake shoe acts on the spindle shank substantially on the opposite side to that in contact with the drive belt. The intensity of the braking action on the spindle is determined, in the current state of the art, by the intensity of the pressure which the operator exerts on the operating lever, which is accessible from the outside of the spinning machine. The operator exerts this action by means of his knee as he has to keep both hands free to be able to join the broken thread. The braking action applied in this manner is therefore extremely variable and tends to be very intense in order to ensure that the spindle halts rapidly and then remains halted, even though it remains in tangential contact with the drive belt, which slides along the shank of the braked spindle.

In traditional spindles of essentially rigid construction, a too high braking pressure does not result in any substantial problems, except perhaps an excessive load on the radial bearing supporting the spindle rod, which with time may lead to damage or centering irregularity.

The use of the more developed spindles known as "elastic" spindles can however result in serious problems when used with the described traditional stop devices. This is because these spindles have a special structure comprising inserts of materials with relative flexibility, to reduce vibration transmission to the machine, and hence reduce the noise generated by the very rapid rotation of the spindles, while at the same time enabling the rotation speed to be increased. In addition, with these spindles the load on the radial bearing is reduced.

If an excessive braking force is exerted on spindles of this type, the spindles can rock angularly (on the upper tip of the spindles) or can rotate non-axially because of said relative elasticity, which causes the spindles to flex when under braking force. This can have repercussions on the adjacent spindles, which can lose rotational speed with consequent breakage of the relative threads. In this respect, the pressing force transmitted onto the drive belt by virtue of the relative elasticity of the spindles can shift it into a position which makes its driving contact with the adjacent spindles precarious, so reducing their rotational speed or making it irregular.

SUMMARY OF THE INVENTION

The main object of the present invention is to provide a device for stopping the spindles of a textile spinning machine, such as a ring spinning machine, which overcomes the aforesaid drawbacks and limitations by providing the optimum braking action for the particular spindles concerned, and including so-called "elastic" spindles, without influencing the adjacent spindles, even if the pressure exerted by the operator on the device is excessive. A further object is to provide a stop spindle which can replace traditional devices without requiring modification to the machine or spindle supports, and hence be easily applied to machines already in use.

A further object is to provide a stop device of the aforesaid type which is of simple structure and easy to use.

These objects are attained according to the invention by a stop device for the spindles of a textile spinning machine, comprising a support body fixable to the machine structure and in which there slides a piston associated with a brake shoe arranged to engage and halt by friction a respective rotating spindle, the piston being moved into its braking position by an operating lever against the action of a return spring acting between the support body and the piston, characterised in that the piston is formed from two parts, one carrying the brake shoe and the other engaging the operating lever, said two parts being slidable relative to each other in the axial direction of the piston, a compression spring being interposed between said two parts.

In a stop device of this type, the braking intensity is no longer determined by the pressure exerted by the operator on the operating lever, but by the spring interposed between the two parts of the piston. In this respect, the brake shoe exerts on the spindle shank a braking force which is directly proportional to the coefficient of elasticity of the spring positioned between the two parts of the piston. This coefficient can be chosen or possibly adapted to take account of the machine characteristics, hence achieving optimum braking action for the particular type of spindle, independently of the force exerted by the operator and hence overcoming the drawbacks of known devices.

A device structured in this manner can maintain the traditional configuration of most of the components of the known devices with the exception of the piston, so that it can be applied to existing machines without the need to modify them. It is also of very simple structure.

BRIEF DESCRIPTION OF THE DRAWINGS

Further details and advantages of the invention will be more apparent from the ensuing description of a preferred embodiment of a device according to the invention, illustrated by way of example on the accompanying drawings, in which.

DESCRIPTION OF THE PREFERRED EMBODIMENT

Figure 1:
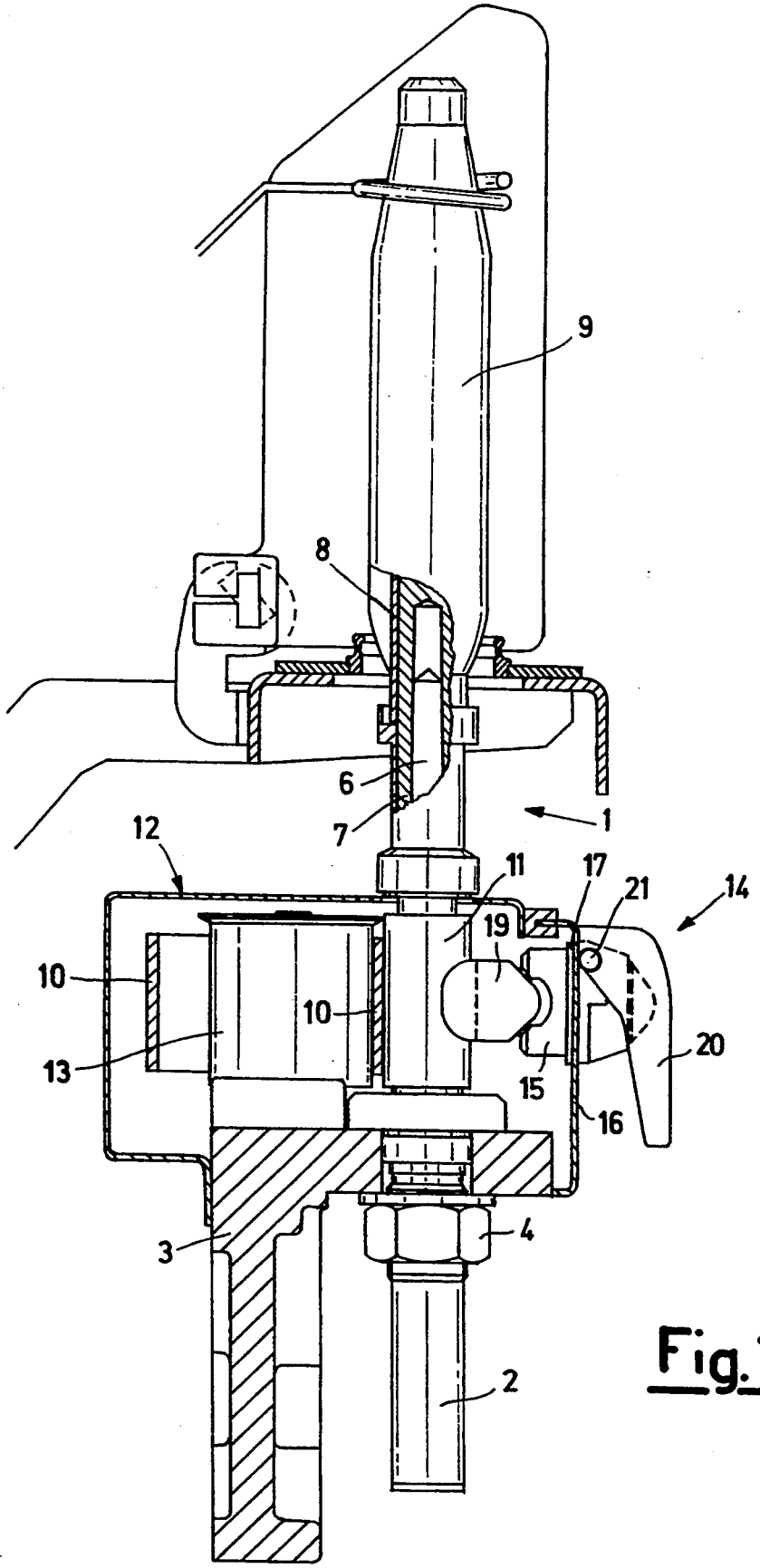
FIG. 1 is a partly sectional view, taken at the spindle, of part of a textile spinning machine comprising a stop device according to the invention.

The drawings show a spindle 1 of known type, of which the fixed support part 2 is fixed to the bed 3 of the textile spinning machine by a nut 4. A bearing 5 rotatably supports the spindle rod 6 which rigidly carries the spindle body 7 on which the tube 8 is mounted to receive thread for forming the bobbin 9. Rotation is transmitted to the spindle 1 by a belt 10 tangentially engaged with the spindle shank 11, which is hollow and is contained within a guard 12 extending along the entire machine and also housing the tensioning rollers 13 for the belt 10, of which one is visible in FIG. 1. The stop device, indicated overall by 14, is positioned in correspondence with the shank 11 of the spindle 1. Each spindle is provided with its own stop device 14.

Figure 2:
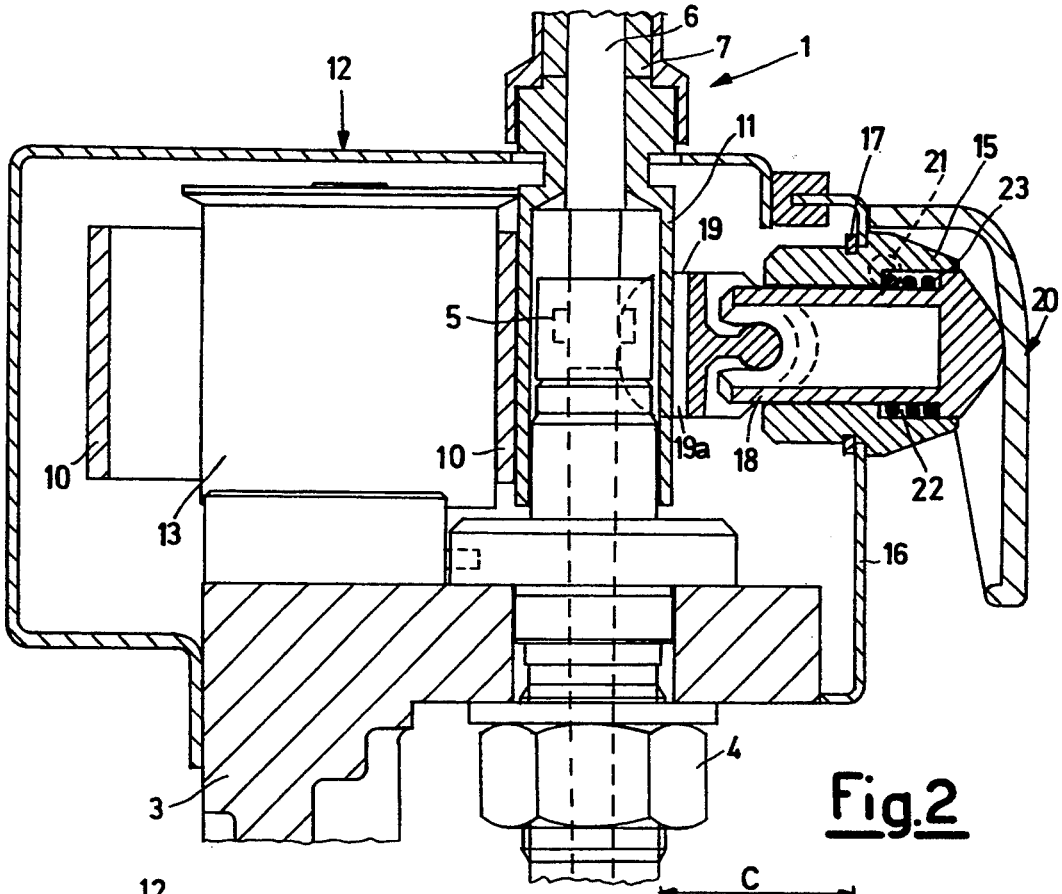
FIG. 2 is a section through a stop device of known type on a scale greater than that of FIG. 1.

A stop device of known type is shown in FIG. 2. It comprises a support body 15 fixed to the wall 16 of the guard 12 by a fixing ring 17. A piston 18 slides within the support body 15 in the axial direction of the body 15, is radial to the axis of the spindle 1. With that end of the piston 18 facing the spindle 1 there is associated by a geometrical connection a brake shoe 19 having a substantially semi-cylindrical braking surface 19*a* of radius equal to that of the shank 11, and arranged to engage the rotating spindle 1 and halt it by friction by acting on the shank 11. At its end distant from that carrying the brake shoe 19, the piston 18 is engaged with an operating lever 20 pivoted on the support body 15 at 21. In a seat 22 defined between the support body 15 and the piston 18 there is provided an axial spring 23, which maintains the engagement between the piston 18 and the lever 20 and acts as a return spring for the piston 18 and lever 20 after they have operated. When in the inactive position shown in FIG. 2, the lever 20 abuts via its upper portion against the wall 16, and the brake shoe 19 is separated from the shank 11 of the spindle 1.

It will be apparent that in this described known device, the intensity of the braking action on the spindle 1 depends on the intensity of the pressure exerted by the operator on the operating lever 20. If the action is too intense it can result in excessibe stressing of the radial bearing 5, and in the case of spindles of the said elastic type in can result in the spindle rod 6 flexing, with misalignment in the rotation of the spindle, the top of which rotates off axis to create oscillation which can have repercussions on the adjacent spindles. In particular, this flexure can lead to a loss of rotational speed of the adjacent spindles, as already stated. Again, as the action on the lever 20 is exerted by the knee of the operator, who has to keep his hands free to insert a new piece of thread between the drafting unit and the braked spindle, it is difficult to exactly control the pressure intensity, which can easily be excessive, with the already stated results.

Figure 3:
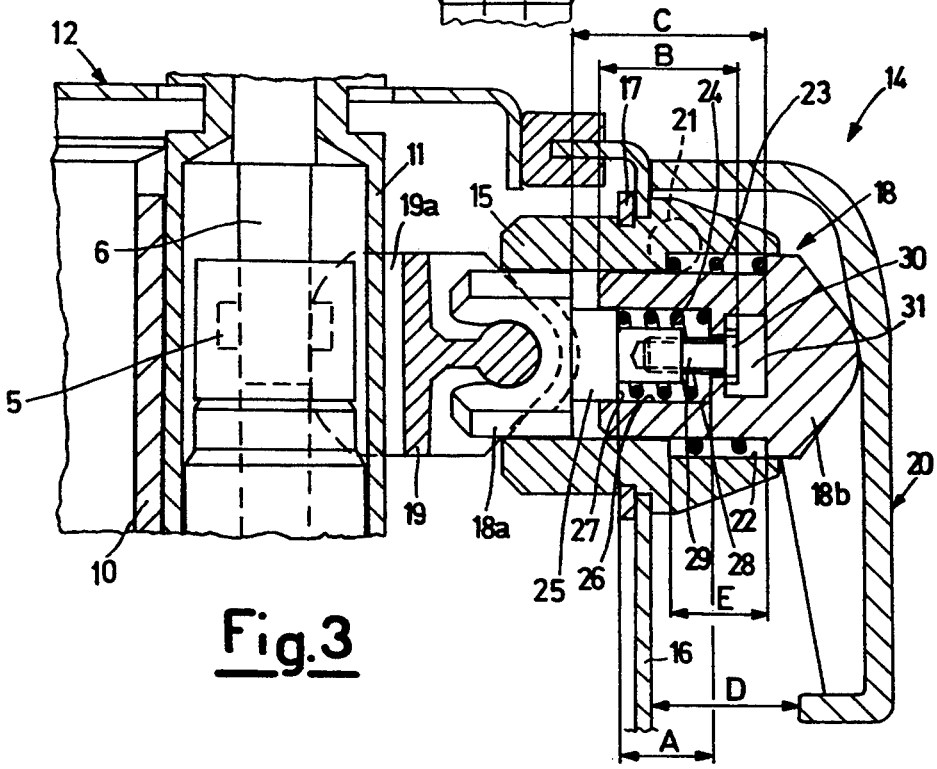
FIG. 3 is a section through a stop device according to the invention on a scale greater than that of FIG. 2.

In contrast, according to the invention the piston 18 is formed from two parts 18*a* and 18*b*, as shown in FIG. 3 in which the same reference numerals as the preceding figures are maintained for equal or equivalent parts. The part 18*a* carries the brake shoe 19, whereas the part 18*b* engages the operating lever 20. The two parts 18*a* and 18*b* are arranged slidable relative to each other within the support body 15 in the axial direction of the piston 18, and between the two parts 18*a* and 18*b* there is interposed a compression spring 24 acting in the sense of withdrawing said parts from each other.

In the illustrated preferred embodiment, the part 18*a* comprises an axial appendix 25 which is slidable in an axial cavity 26 provided in the part 18*b*. The spring 24 is advantageously arranged in the cavity 26 between a step 27 on the axial appendix 25 and the base 28 of the cavity 26. This construction advantageously enables good guiding of the two parts to be maintained in an axial direction, together with good stability under the braking force.

The two parts 18*a* and 18*b* are preferably provided with means for limiting the relative movement of the two parts under the action of the compression spring 24, which under these conditions is preloaded when in the position defined by these means. In the illustrated embodiment, these means consist of a screw 29 screwed axially into the part 18*a* and supported rotatably in the part 18*b*, so that its head 30 is accessible through an aperture 31 provided in the part 18*b*. By rotating the screw 29 the two parts 18*a* and 18*b* are made to move towards or away from each other, so varying the preloading of the spring 24. In this manner the force of the spring 24 can be adjusted to obtain optimum braking pressure on the basis of the particular characteristics of the machine and/or spindles.

From the aforegoing description it will be apparent that in a stop device 14 according to the invention it is the spring 24 which determines the intensity of the braking force, which is independent of the force exerted by the operator on the operating lever 20. In this respect, when the brake shoe 19 makes contact with the shank 11 of the spindle 1, the part 18*a* no longer follows the movement of the part 18*b*, determined by the extent of rotation of the lever 20, but instead compresses the spring 24 which therefore establishes the intensity of the braking pressure on the basis of the coefficient of elasticity of the spring. It is therefore possible to achieve optimum braking action, in all cases preventing a too intense braking pressure, even with the lever 20 at the limit of its operational rotation.

It should be noted that the axial distance between the two parts 18*a* and 18*b* must be such that the parts do not enter into direct frontal contact, even when the lever 20 is in its position of maximum exerted force. The aperture 31 must therefore have a dimension in the axial direction of the piston 18 such that the head 30 of the screw 29 never makes contact with the opposite wall to that engaged by said head when the device 14 is in its active state. With reference to the distances A, B, C, D, E indicated in FIG. 3, the following relationships apply:

when the device 14 is in its inactive state (shown in FIG. 3), A is less than B, and C is greater than A;

when the device 14 is in its active state, in which case D=0, B is approximately equal to C, both are greater than A, and E is greater than D.

The spring 24 interposed between the two parts 10*a* and 10*b* has a coefficient of elasticity which is less than that of the return spring 23. The springs 23 and 24 can however be chosen such that the spring 23 has a coefficient of elasticity less than that of the spring 24, within certain limits.

A device according to the invention does not require modifications to be made to the support body 15, the operating lever 20 or the brake shoe 19 associated with known devices, so that it can be applied instead of known devices without requiring modifications to the spinning machine.

The structure of the parts 18*a* and 18*b* could be modified such that a portion of the part 18*b* slides within the part 18*a* instead of vice versa. The spring 24 could be interposed between front surfaces of the said two parts, suitably spaced apart axially. The spring 24 could also not be preloaded when the device is in its rest position.

With all these arrangements, the device maintains its simplicity and ease of use, without presenting the aforesaid drawbacks of known devices.

We claim:

1. A stop device for a spindle of a textile spinning machine comprising a support body adapted to be secured to a textile spinning machine adjacent a spindle, a brake shoe having a brake surface contoured to the configuration of a spindle for frictionally halting spindle rotation, piston means disposed between said brake shoe and said support body for moving said brake shoe toward a braking position thereof, said piston means being defined by first and second relatively movable piston parts, means for articulately connecting said first piston part to said brake shoe, lever means activated by an operator for engaging said second piston part, first spring means in external surrounding relationship to said first piston part and in internally housed relationship to a cavity of said second piston part for transmitting a force created by the actuation of said lever means against said second piston part through said first spring means to said first piston part, and second spring means in external surrounding relationship to said second piston part for biasingly returning said second piston part to a nonbraking position upon the deactivation of said lever means whereby said brake shoe is brought to a nonbraking position through said first piston part and said articulately connecting means.

2. The stop device as defined in claim 1 wherein said first piston part includes a stem projecting into said cavity, and said first spring means is in surrounding relationship to said stem.

3. The stop device as defined in claim 2 including means for limiting the relative movement of said first and second piston parts away from each other in said nonbraking position.

4. The stop device as defined in claim 2 including means for limiting the relative movement of said first and second piston parts away from each other in said nonbraking position, and said first spring means is preloaded when said first and second piston parts are in their position of limited movement.

5. The stop device as defined in claim 2 including means for limiting the relative movement of said first and second piston parts away from each other in said nonbraking position, said first spring means is preloaded when said first and second piston parts are in their position of limited movement, said limiting means is defined by screw means rotatably interconnected between said first and second piston parts for increasing and decreasing the relative movement therebetween by selectively threading and unthreading said screw means.

6. The stop device as defined in claim 1 wherein said first piston part includes a stem projecting into said cavity, said first spring means is in surrounding relationship to said stem, said cavity and stem each include a spring seating surface, and said first spring means being confined between said spring seating surfaces.

7. The stop device as defined in claim 6 including means for limiting the relative movement of said first and second piston parts away from each other in said nonbraking position.

8. The stop device as defined in claim 6 including means for limiting the relative movement of said first and second piston parts away from each other in said nonbraking position, and said first spring means is preloaded when said first and second piston parts are in their position of limited movement.

9. The stop device as defined in claim 6 including means for limiting the relative movement of said first and second piston parts away from each other, said first spring means is preloaded when said first and second piston parts are in their position of limited movement, said limiting means is defined by screw means rotatably interconnected between said first and second piston parts for increasing and decreasing the relative movement therebetween by selectively threading and unthreading said screw means.

10. The stop device as defined in claim 1 including means for limiting the relative movement of said first and second piston parts away from each other.

11. The stop device as defined in claim 1 including means for limiting the relative movement of said first and second piston parts away from each other in said nonbraking position, and said first spring means is preloaded when said first and second piston parts are in their position of limited movement.

12. The stop device as defined in claim 1 including means for limiting the relative movement of said first and second piston parts away from each other in said nonbraking position, said first spring means is preloaded when said first and second piston parts are in their position of limited movement, said limiting means is defined by screw means rotatably interconnected between said first and second piston parts for increasing and decreasing the relative movement therebetween by selectively threading and unthreading said screw means.

13. A stop device for a spindle of a textile spinning machine comprising a support body adapted to be secured to a textile spinning machine adjacent a spindle, a brake shoe having a brake surface contoured to the configuration of a spindle for frictionally halting spindle rotation, piston means disposed between said brake shoe and said support body for moving said brake shoe toward a braking position thereof, said piston means defined by first and second relatively movable piston parts, means for articulately connecting said first piston part to said brake shoe, lever means activated by an operator for engaging said second piston part, first spring means for transmitting a force created by the actuation of said lever means against said second piston part through said first spring means to said first piston part, second spring means for biasingly returning said second piston part to a nonbraking position upon the deactivation of said lever means whereby said brake shoe is brought to a nonbraking position through said first piston part and said articulately connecting means, means for limiting the relative movement of said first and second piston parts away from each other in said nonbraking position, and means for preloading said first spring means when said first and second piston parts are in their position of limited movement.

14. The stop device as defined in claim 13 wherein said limiting means is a member connecting said first and second piston parts for limited sliding movement relative to each other.

15. The stop device as defined in claim 13 wherein said preloading means includes a threaded connection between said limiting means and said first piston part.

16. The stop device as defined in claim 13 wherein said preloading means includes a bolt.

17. The stop device as defined in claim 13 wherein said preloading means includes a bolt having a head at one end and a thread at an opposite end, said thread being adjustably threaded in one of said first and second piston parts, and said head being confined by the other of said first and second piston parts.

* * * * *